US010252141B2

(12) United States Patent
Chiang et al.

(10) Patent No.: US 10,252,141 B2
(45) Date of Patent: Apr. 9, 2019

(54) EXERCISE APPARATUS WITH TEMPERATURE VARIABLE HANDLE ASSEMBLY

(71) Applicants: Hsin-Huang Chiang, Taichung (TW); Cheng-Kun Lee, Taichung (TW); Shu-Wei Chang, Taichung (TW); Joe Chen, Taichung (TW); I-Lun Chen, Taichung (TW)

(72) Inventors: Hsin-Huang Chiang, Taichung (TW); Cheng-Kun Lee, Taichung (TW); Shu-Wei Chang, Taichung (TW); Joe Chen, Taichung (TW); I-Lun Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 207 days.

(21) Appl. No.: 15/250,947

(22) Filed: Aug. 30, 2016

(65) Prior Publication Data

US 2018/0056111 A1 Mar. 1, 2018

(51) Int. Cl.
*A63B 22/04* (2006.01)
*A63B 22/00* (2006.01)
(Continued)

(52) U.S. Cl.
CPC ..... *A63B 71/0619* (2013.01); *A63B 22/0605* (2013.01); *A63B 24/0087* (2013.01);
(Continued)

(58) Field of Classification Search
CPC ..... A63B 24/0087; A63B 21/4035; A63B 21/4034; A63B 21/00069; A63B 21/0051; A63B 22/0076; A63B 22/02; A63B 22/04; A63B 22/0605; A63B 22/0664; A63B 23/03516; A63B 71/0619; A63B 2225/64; A63B 2225/66; A63B 2230/06; A63B 2225/50; A63B 71/0622; A63B 2225/20; A63B 24/0062; A63B 24/00;
(Continued)

(56) References Cited

U.S. PATENT DOCUMENTS 5,572,881 A * 11/1996 Hotta ..... B60H 1/00392 62/278
8,920,288 B2 * 12/2014 Dalebout ..... A63B 71/0622 482/1

(Continued)

*Primary Examiner* — Andrew S Lo

(57) ABSTRACT

An exercise apparatus includes a motion mechanism and a handle assembly. The motion mechanism is provided for a user to perform exercise. The handle assembly has at least one grip portion for being held by the user during exercising. Specifically, the grip portion has a temperature variable area thereon. The temperature of the temperature variable area could be controlled to rise to a suitable temperature that the hand of the user can feel warm, for example, a temperature between 38 and 50 degrees Celsius. The temperature of the temperature variable area could also be controlled to reduce to a suitable temperature that the hand of the user can feel cool, for example, a temperature between 20 and 36 degrees Celsius. The temperature of the temperature variable area could be directly controlled by the user or automatically changed according to the exercise status of the user.

19 Claims, 3 Drawing Sheets

(51) Int. Cl.
*A63B 71/06* (2006.01)
*A63B 22/06* (2006.01)
*A63B 24/00* (2006.01)
*A63B 22/02* (2006.01)

(52) U.S. Cl.
CPC ..... *A63B 22/0076* (2013.01); *A63B 22/02* (2013.01); *A63B 22/04* (2013.01); *A63B 22/0664* (2013.01); *A63B 2225/64* (2013.01); *A63B 2225/66* (2013.01); *A63B 2230/06* (2013.01); *A63B 2230/505* (2013.01)

(58) Field of Classification Search
CPC ..... A63B 2230/75; A63B 22/0242; A63B 2071/0658; A63B 2071/065
USPC ..... 482/4
See application file for complete search history.

(56) References Cited

U.S. PATENT DOCUMENTS 9,877,685 B2 * 1/2018 Kwon ..... A61B 5/7221
2004/0018917 A1 * 1/2004 Corbalis ..... A63B 22/02 482/54
2004/0097341 A1 * 5/2004 Alessandri ..... A63B 21/00 482/54
2007/0161461 A1 * 7/2007 Nguyen ..... A61H 15/0078 482/44
2008/0097633 A1 * 4/2008 Jochelson ..... A63B 71/0686 700/94
2009/0023553 A1 * 1/2009 Shim ..... A63B 22/02 482/4
2009/0145162 A1 * 6/2009 Goldmann ..... F24F 1/0007 62/426
2009/0253554 A1 * 10/2009 McIntosh ..... A63B 21/00 482/4
2011/0061840 A1 * 3/2011 Goldmann ..... F24F 1/0007 165/104.34
2011/0065373 A1 * 3/2011 Goldmann ..... F24F 1/0007 454/251
2013/0035208 A1 * 2/2013 Dalebout ..... A63B 71/0622 482/8
2013/0267383 A1 * 10/2013 Watterson ..... A63B 22/0235 482/4
2014/0194248 A1 * 7/2014 Kolman ..... A63B 71/0622 482/4
2016/0023049 A1 * 1/2016 Dalebout ..... A63B 22/0242 482/7
2016/0058388 A1 * 3/2016 Kwon ..... A61B 5/7221 600/547
2016/0213976 A1 * 7/2016 So ..... A63B 71/0622
2017/0203157 A1 * 7/2017 Volkerink ..... A63B 24/0087
2017/0336089 A1 * 11/2017 Bazar ..... F24F 11/0034

* cited by examiner

EXERCISE APPARATUS WITH TEMPERATURE VARIABLE HANDLE ASSEMBLY

BACKGROUND

1. Field of the Invention

The present invention relates to an exercise apparatus. More particularly, the present invention relates to an exercise apparatus with handles.

2. Description of the Related Art

Nowadays various exercise apparatuses such as treadmills, indoor cycles, ellipticals, stair exerciser apparatuses, steppers, rower machines, weight training apparatuses, and almost all exercise apparatuses have handlebars for allowing a user to grip during exercise. The handlebars according to their type and main function can be summarized into four categories: First, fixed handlebars for people to hold to stabilize the body to avoid falling, such as the treadmill, the handlebars at front end or two sides of the stair exerciser apparatus; Second, fixed handlebars for people to grip to stabilize the upper body for supporting the movement of the lower body, such as the handlebar at front end of the upright bike, the handlebars at two side of the seat of the recumbent bike, or the handlebars of other leg exercise weight training machine; Third, movable handlebars for allowing people to choose to grip during exercise for additional movement, such as most ellipticals have movable handlebars that could be swingable forward and backward; fourth, movable handlebars for people to grip during exercise, such as the handlebar of the rower machine, the movable handlebars of other weight training machines by movement of hands. Some exercise apparatuses may have two or more handle sets, for example, the recumbent bike generally has two fixed handle sets (disposed at a front of the bike and two sides of the seat), and the elliptical may have one fixed handle set and one movable handle set.

In the conventional technique, in addition to provide above main functions as the user holds the handlebar of the exercise apparatus, some may install heart rate sensors on the grip portions of the handlebar and/or control buttons corresponding to the location of thumbs for detecting the heart rate of the user and allowing the user to input a command. In addition, the handlebar of the conventional exercise apparatus rarely has other functions.

In other hand, although the aforementioned exercise apparatuses are known for indoor use so that the user is not exposed outdoor environment, the body temperature may be higher than usual 1-2 degrees C. or more according to the intensity and the duration during exercise. Therefore, even used indoor, the exercise apparatus user may be in a high body temperature or overheating state after exercising for a period of time. If the body keeps heating without well heat radiating, especially in the high indoor temperature, high humidity, worse ventilation or improper dress, it may cause the user to feel uncomfortable during exercise or after exercise, or heat injury such as febrile convulsion or heat exhaustion. Some exercise apparatuses have a small fan blowing toward the user on the console for assisting the user to cool down the skin so as to avoid the user's body temperature continuing to rise.

In another hand, before the relatively intense formal exercise, it is best to perform warm-up exercise first to let the body gradually into a state suitable for high-intensity exercise, including moderately increasing body temperature, accelerating heart rate and blood circulation, increasing oxygen content of the muscle tissue, etc. so as to enhance athletic performance and avoid sport injuries. Relatively, after the formal exercise, it is best to perform cool-down exercise to let the body gradually back to normal state so as to avoid accumulation of metabolites in the muscle tissue to cause pain and even injury. In general, when a user performs a specific exercise by a specific exercise apparatus, the user usually performs a low-intensity exercise directly on the exercise apparatus for a period of time or gradually increases the exercise intensity as the warm-up exercise; and performs a low-intensity exercise on the exercise apparatus for a period of time or gradually decreases the exercise intensity as the cool-down exercise. The user could follow an exercise program with a warm-up period and a cool-down period to do exercise, or manually adjust the exercise intensity (such as adjusting the speed of the treadmill belt), or control the exercise speed by himself (such as slow down the pedaling speed on the bike), so that the user could perform the warm-up exercise and the cool-down exercise respectively in the period of time after the beginning of exercise and in the period of time before the end of exercise. However, if the overall exercise time is not long enough, the occupied time for warm-up exercise and cool-down exercise is also shortened to cause lack of the warm-up and cool-down effects. For example, since the time for warm-up exercise is too short, the user's body temperature is not warm enough to perform the high-intensity exercise, which may hurt muscles, muscle tendons or joints easily. Further, since the time for cool-down exercise is too short, the user's muscle and heart may be still in a state of excitement and high body temperature as the exercise is finished. Also, for physical factors, some people may be hard to rise the body temperature in the warm-up stage, or hard to reduce the body temperature in the cool-down stage.

Furthermore, in the formal exercise stage, the user is best to keep the exercise intensity within a suitable range in accord with the user's age and physical ability to obtain the best exercise effect and avoid danger due to excessive exercise. Some exercise apparatuses are able to detect the user's heart rate during exercise and display that on console as reference or index for the exercise intensity, namely, when the heart rate is lower than an ideal heart rate range (generally depends on ages), it represents that the exercise intensity is too low at that time to achieve the predetermined movement effect, so that the user should enhance the exercise intensity. In contrast, when the heart rate is higher than the ideal heart range, it represents that the exercise intensity is too high at that time to make the heart overburden, so that the user should decrease the exercise intensity. Some exercise apparatuses may measure the metabolic equivalent (MET) of users and display that on console as reference or index for the exercise intensity. In the conventional technique, in a specific operation mode of some exercise apparatuses, it will automatically increase/decrease the difficulty of the motion mechanism as detecting that the user's heart rate or metabolic equivalent is too low/high, such as automatically increasing/decreasing the speed of the treadmill belt, increasing/decreasing the pedaling resistance of the bike so as to increase/decrease the exercise intensity of the user for guiding the user to perform the exercise with a suitable exercise intensity.

SUMMARY

The main object of the present invention provides an exercise apparatus, and its handles are provided for a user to get a sense of warm or cool through hands depending on the situation so as to adjust the body temperature of the user for allowing the user to perform and complete the exercise in a better condition.

Another object of the present invention provides an exercise apparatus for allowing a user to rise the body temperature during a warm-up stage of exercise to achieve warm up effect.

Another object of the present invention provides an exercise apparatus for allowing a user to reduce the body temperature during a cool-down stage of exercise to achieve cool down effect.

The other object of the present invention provides an exercise apparatus being capable for inducing the user to increase the exercise intensity as determining that the exercise intensity is too low, and inducing the user to decrease the exercise intensity as determining that the exercise intensity is too high so as to help the user to achieve good movement effect and avoid over training.

According to one aspect of the present invention, an exercise apparatus comprises a motion mechanism for a user to perform an exercise; a handle assembly having at least one grip portion for being held by the user during exercising, the grip portion having at least one temperature variable area thereon; at least one temperature changing device configured to changing the temperature of the temperature variable area on the grip portion of the handle assembly; an input unit for the user to input a command; a display unit for displaying information to the user; and a control unit configured to receive and process the command from the input unit. Besides, the control unit is able to control the display unit to show the information, and control the temperature changing device to rise or reduce the temperature of the temperature variable area. The control unit is configured to rise the temperature of the temperature variable area to a warm temperature range (generally above 38 degrees Celsius such as a suitable temperature between 38 and 50 degrees Celsius) and to reduce the temperature of the temperature variable area to a cool temperature range (generally below 36 degrees Celsius such as a suitable temperature between 20 and 36 degrees Celsius). Therefore, the user could obtain the sense of warm or cool by holding the grip portion depending on the situation so as to adjust the body temperature for allowing the user to perform and complete the exercise in a better condition.

Preferably, the control unit is able to control the temperature changing device according to exercise status of the user to automatically rise or reduce the temperature of the temperature variable area during the exercise.

Preferably, the control unit is controlled to rise the temperature of the temperature variable area during a warm-up stage of the exercise.

Preferably, the control unit is controlled to reduce the temperature of the temperature variable area during a cool-down stage of the exercise.

Preferably, the exercise apparatus further comprises at least one physiology sensing device for detecting at least one physiology parameter of the user, and the control unit is controlled to rise or reduce the temperature of the temperature variable area according to the physiology parameter. The at least one physiology sensing device comprises a heart rate sensor for detecting a heart rate of the user. The control unit is able to receive values of the heart rate. The control unit is controlled to rise the temperature of the temperature variable area when the heart rate value is below a predetermined range and the temperature of the temperature variable area is below an upper temperature limit. In contrast, the control unit is controlled to reduce the temperature of the temperature variable area when the heart rate value is above the predetermined range and the temperature of the temperature variable area is above a lower temperature limit.

Preferably, the exercise apparatus further comprises a speed sensor for detecting movement speed of the motion mechanism for the user to perform the exercise. The control unit is able to receive movement speed values detected from the speed sensor. The control unit is controlled to rise the temperature of the temperature variable area when the movement speed value is below a predetermined range and the temperature of the temperature variable area is below an upper temperature limit. In contrast, the control unit is controlled to reduce the temperature of the temperature variable area when the movement speed value is above the predetermined range and the temperature of the temperature variable area is above a lower temperature limit.

Preferably, the exercise apparatus further comprises a difficulty changing device configured to change difficulty level of the motion mechanism for the user to perform the exercise. The control unit is able to calculate exercise intensity during the exercise according to the difficulty level and the movement speed value. The control unit is controlled to rise the temperature of the temperature variable area when the exercise intensity is below a predetermined range and the temperature of the temperature variable area is below an upper temperature limit. In contrast, the control unit is controlled to reduce the temperature of the temperature variable area when the exercise intensity is above the predetermined range and the temperature of the temperature variable area is above a lower temperature limit.

Further benefits and advantages of the present invention will become apparent after a careful reading of the detailed description with appropriate reference to the accompanying drawings.

DETAIL DESCRIPTION

Figure 1:
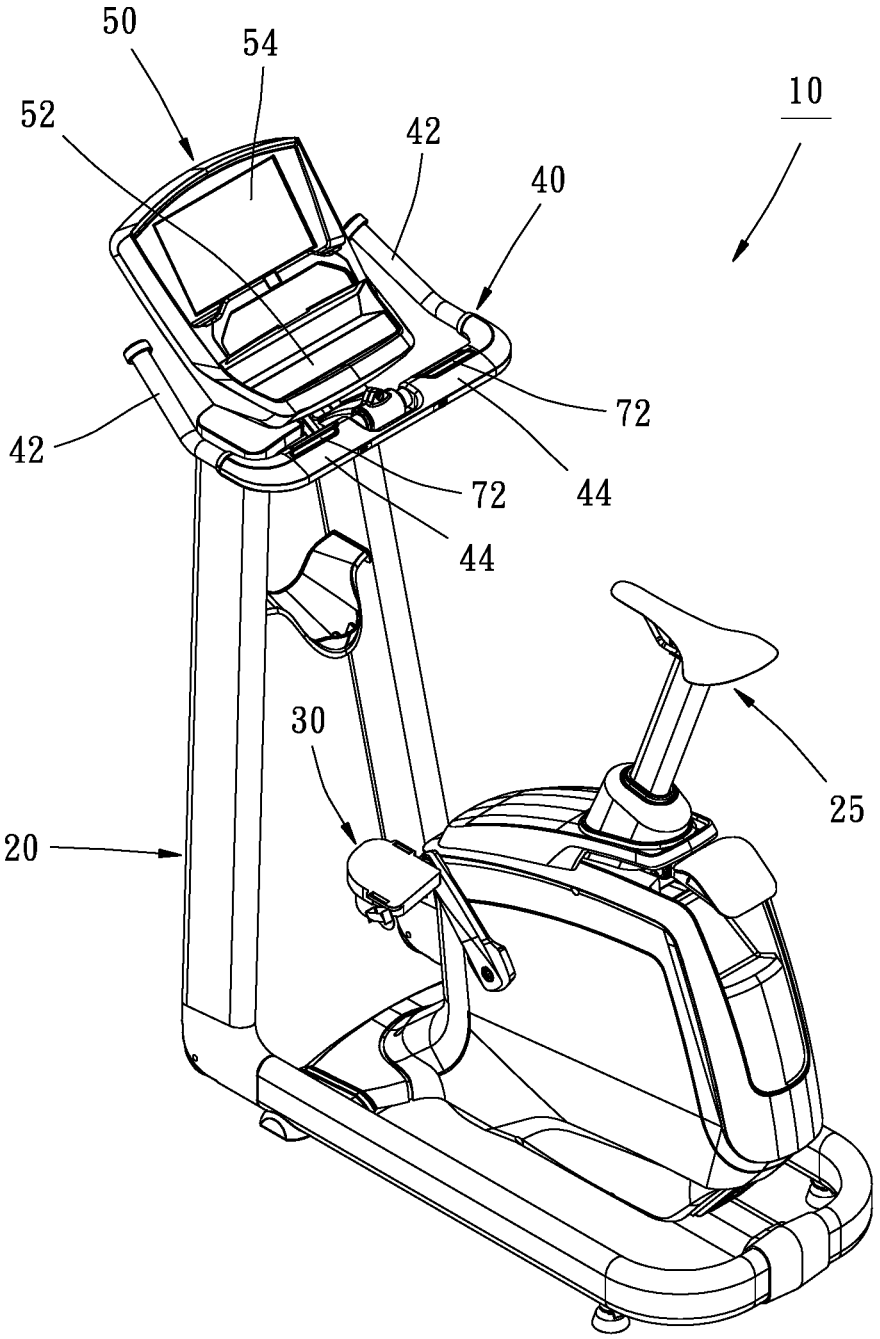
FIG. 1 is a perspective view of an exercise apparatus in accordance with a preferred embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

The present invention provides a handle assembly with a temperature changing function which may be applied to various exercise apparatus which have grips, such as treadmills (including running machine and walking machine), indoor cycles (including upright bike and recumbent bike), ellipticals, stair exerciser apparatuses, steppers, rower machines, weight training machines and other common exercise apparatuses, and other special type exercise apparatuses but used in the same field, such as cross trainers, spacewalk machines, horse riding machines, or particular brands of "Tread Climber", "Adaptive Motion Trainer", "Arc Trainer", or the like. However, the invention could also be applied to other exercise apparatuses which are not listed. In addition to cardio function apparatuses and weight training apparatuses, the present invention could also be applied to passive exercise apparatuses without active power by a user, such as a motor-driven revolving pedal rehabilitation indoor bike.

The aforementioned exercise apparatuses have respective motion mechanisms for a purpose of executing a particular exercise. For example, a treadmill has a belt mechanism for allowing the user to perform the exercise of running or walking, an indoor bike and an elliptical have a pedal mechanism for allowing the user to perform the exercise of pedaling, and a stair exerciser apparatus has a stair mechanism for allowing the user to perform the exercise of stair climbing, or the like. The motion mechanisms of the respective exercise apparatuses are technological background of the art, the specific structures are not substantially connected to the content of the present invention so the details are not be mentioned the specification.

The exercise apparatuses which are suitable for the present invention each has at least one handle set for being gripped by a user to perform an exercise. For example, the fixed handlebars at the front end or two sides of the treadmill, the fixed handlebars at the front end or two sides of the stair exerciser apparatus, which allow the user to grip during the exercise of walking, jogging or stair climbing so as to stabilize the user's body to avoid falling. The fixed handlebars at the front end of the upright and recumbent bike, the fixed handlebars at two sides of the seat of the recumbent bike, the fixed handlebars at the front end of the elliptical, other leg exercise weight training machine (e.g. leg press, leg extension) etc., which allow the user to grip during every kind of leg exercise to stabilize the user's upper body for supporting the movement of the lower body. The movable handlebars at the front of the elliptical, which allow the user to choose to grip the movable handlebars during leg exercise of pedaling to accompany push-pull motion of the user's hands (note: such handle set could be deemed one part of the motion mechanism). The movable handlebar of the rower machine, the movable handlebars of other weight training machines by movement of hands (e.g. chest press, shoulder press) etc., which allow the user to grip during the exercise of rowing for performing such exercise (note: such handle set could be deem one part of the motion mechanism). The exercise apparatuses suitable for the present invention may have two or more sets of identical or different functional handlebars. For example, the recumbent bike has two sets of fixed handlebars respectively mounted at the front end of the bike and the two sides of the seat, and the elliptical has one set of fixed handlebar and one set of movable handlebar. The basic structure, arrangement, main function, etc. of the handle assembly of the exercise apparatuses are technological background of the art, they are all suitable in the exercise apparatus of the present invention.

FIG. 1 depicts an appearance of an exercise apparatus 10 in accordance with a preferred embodiment of the present invention, comprises a frame 20, a motion mechanism 30 for allowing a user to perform a particular exercise, a handle assembly 40 for being gripped by the user during exercise, and a console 50 as a human-machine interface. The exercise apparatus of the present invention is based on an upright bike. Accordingly, the motion mechanism 30 indicates a pedal mechanism for a user who sits on a seat 25 to perform exercise of pedaling. The handle assembly 40 is fixed at the upper front of the exercise apparatus relative to the seat 25 (note: the positions of the handle assembly 40 and the seat 25 are adjustable, but being fixed during exercise) so as to allow the user to reach his hands forward to grip the handle assembly 40 while performing the movement of pedaling and thereby stabilizing the upper body of the user to assist in the pedaling movement of two legs.

Figure 2:
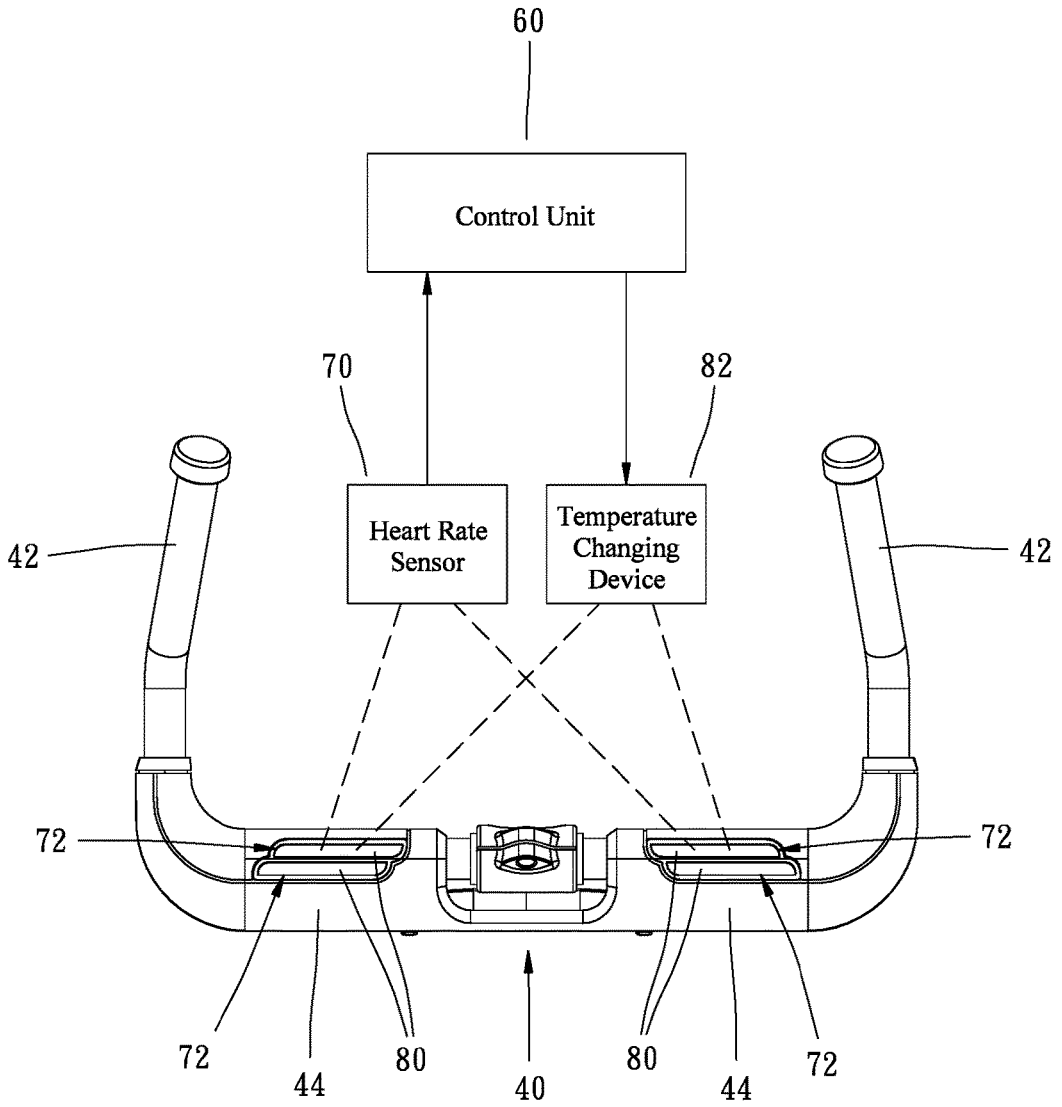
FIG. 2 is a schematic diagram illustrating electrical functions of a handle assembly of the preferred embodiment of the present invention.

Referring to FIG. 2, the handle assembly 40 of the present invention is substantially U-shaped with an opening toward the front, has a pair of symmetrical first grip portions 42 and a pair of symmetrical second grip portions 44. The pair of first grip portions 42 is defined at two side sections of the U-shaped handle assembly 40, which are disposed outward and forward at two opposite sides for allowing the user to grip with two hands. The pair of second grip portions 44 is defined at the middle section of the U-shaped handle assembly 40, which are disposed inward and rearward for allowing the user to grip with two hands. The user can choose to grip the first grip portions 42 or the second grip portions 44 or not depending on the requirement at any time during exercise.

Figure 3:
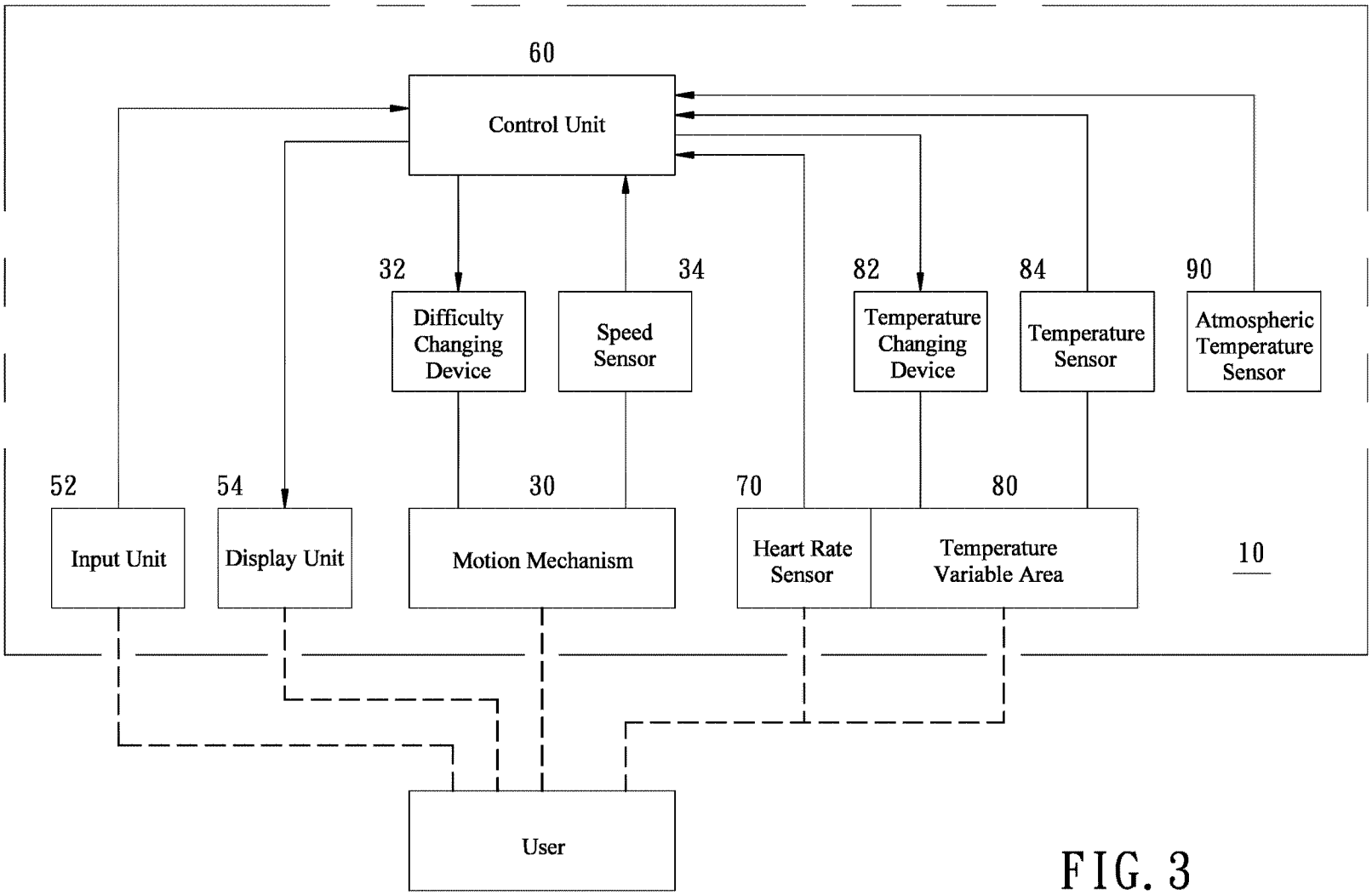
FIG. 3 is a functional block diagram of the exercise apparatus of the preferred embodiment of the present invention.

The console 50 has at least one input unit 52 for allowing the user to input a command such as a keyboard or a touch control device, and at least one display unit 54 for displaying information to the user such as LCD or LED devices. The console 50 has a control unit 60 electrically connected to the input unit 52 and the display unit 54 inside, as shown in FIG. 3, which could receive and process the command from the input unit 52 and control the display unit 54 to show the information. In the preferred embodiment of the present invention, the control unit 60 indicates the correlated hardware and software/firmware which could process electrical signals in a predetermined way, such as a programmed controlled circuit with a microcontroller unit (MCU) built in a specific program for a core of the circuit. However, the input unit 52, the display unit 54 and the control unit 60 are technological background of the art, the specific structures are not substantially connected to the content of the present invention so the details are not be mentioned the specification.

As shown in FIG. 3, the exercise apparatus 10 further comprises a difficulty changing device 32 configured to change difficulty level of the motion mechanism 30 for a user to perform an exercise. The control unit 60 is electrically connected to the difficulty changing device 32. The control unit 60 is able to control the difficulty changing device 32 immediately according to a command about a requirement of difficulty that is inputted by the user via the input unit 52 (e.g. requirements for difficulty increasing or decreasing, or requirements for a specific level), or control the difficulty changing device 32 sequentially according to an exercise program which includes a time setting item and a difficulty setting item to change difficulty level of the motion mechanism 30 during exercise. The control unit 60 is able to control the display unit 54 to show the difficulty information of the exercise as well.

In the case of indoor bikes, the difficulty changing device 32 is a resisting device which could apply predetermined resistance to the motion mechanism 30 (pedal mechanism) such as eddy current brake (ECB) which is commonly used. The difficulty or intensity of the pedaling exercise is increased (or decreased) while the resistance is increased (or decreased). In the case of other exercise apparatus, for example, the difficulty changing device of the elliptical is generally a resistance device which could apply predetermined resistance to the pedal mechanism as well. Further, the difficulty changing device of the treadmills for running or walking is generally a driving device for driving the belt to rotate in a predetermined speed. The difficulty or intensity of the running or walking exercise is increased (or decreased) while the belt speed is increased (or decreased). Additionally, the difficulty changing device of some treadmills may include another driving device for driving the platform of the treadmill to change its inclined angle. The difficulty or intensity of the running or walking exercise is increased (or decreased) while the inclined angle is increased (or decreased). Further, the difficulty changing device of the stair exerciser apparatus is generally a resistance device which could apply predetermined resistance to the stair mechanism. When the resistance applied to the stair exerciser apparatus is increased (or decreased), the downward speed of the stairs is decreased (or increased) so as to decrease (or increase) the difficulty or intensity of the climbing exercise, and so on. However, the difficulty changing devices of various exercise apparatuses are just technological background of the art, the specific structures are not substantially connected to the content of the present invention so the details are not be mentioned the specification.

Referring to FIG. 3, the exercise apparatus 10 further comprises a speed sensor 34 for detecting the movement speed of the motion mechanism 30 for the user to perform the exercise. The control unit 60 is electrically connected to the speed sensor 34. The control unit 60 is able to receive movement speed values detected from the speed sensor 34 and control the display unit 54 to show the information about the movement speed. For example, to calculate the forward distance for treadmills or bikes (kilometers per hour) or the reciprocating motion for steppers or rower machines (times per minute).

In the case of indoor bikes, normally, the speed sensor 34 is a rotational speed sensor which is able to detect the rotational speed of the pedal mechanism or the components revolved with the pedal mechanism (e.g. flywheel or pulley). For example, the grating disk cooperating with light sensor is widely used, when detecting that the rotational speed becomes faster/slower, it represents that the user pedals faster/slower. In other exercise apparatuses like treadmills, ellipticals or stair exerciser apparatuses, their speed sensor is generally a rotational speed sensor which is able to detect the rotational speed of the components revolved with the motion mechanism such as the rotational speed of the belt roller, the flywheel, the pulley, the driving motor of the treadmill, the rotational speed of the crank mechanism, the flywheel, the pulley of the elliptical, or the rotational speed of the sprocket, the flywheel, the pulley of the stair exerciser apparatus. Another example, the speed sensors of the stepper, the rower machine, the weight training machine that are configured to detect the frequency of their reciprocating motion (e.g. the upward and downward reciprocating motion of the pedals of the stepper, the forward and rearward reciprocating motion of the handlebar of the rower machine), or the like. The speed sensors of various exercise apparatuses are technological background of the art, the specific structures are not substantially connected to the content of the present invention so the details are not be mentioned the specification.

Referring to FIG. 2, the exercise apparatus 10 has a heart rate sensor 70 for detecting the heart rate of the user which comprises four elongated metal plates 72 mounted on the pair of second grip portions 44 of the handle assembly 40. Two of the metal plates 72 are arranged parallel on the top of the left side second grip portions 44, the other two of the metal plates 72 are arranged parallel on the top of the right side second grip portions 44. Each metal plate 72 is extended along the lengthwise direction of the respective second grip portion 44 (corresponding to the left-right axial direction), and the extending length of each metal plate 72 is greater than the width of the palm of a human hand. When the user grips the pair of second grip portions 44, the palms of two hands could simultaneously touch the four metal plates 72. The heart rate sensor 70 further comprises a sensing circuit (not shown) built in the handle assembly 40 and electrically connected to the metal plates 72. It is able to sense the electrocardiograph (ECG) signals and/or the electromyogram (EMG) signals of the user's hands via the metal plates 72 so as to detect the occurrence and frequency of the heartbeats of the user. However, such heart rate sensor through the metal plates sensing heart rate is a conventional technology in the exercise apparatuses, so that the correlated principle is omitted herein. With respect to the choice of types and designs, the number, shape, size, distribution, etc. of the aforementioned metal plate may differ from the configuration shown in FIG. 2. For example, in other embodiment (not shown), each grip portion may have two metal plates disposed at opposite sides of the cylindrical handlebar, or most surface of each grip portion are formed by metal plate. The control unit 60 is electrically connected the heart rate sensor 70. The control unit 60 is able to receive heart rate values detected from the heart rate sensor 70, and to control the display unit 54 to display the heart rate information.

Referring to FIG. 2 and FIG. 3, the exercise apparatus 10 further comprises a temperature changing device 82 such as an electric heating device for converting electrical energy into heat energy, a cooler/heater device by application of thermoelectric material or thermoelectric chips, heat pump, radiant heater, convection heater, fan heater, immersion heater, electromagnetic heater, water cooler, etc. The temperature changing device 82 is thermally connected to the metal plates 72 for allowing temperature variation of each metal plate 72 including temperature rising and cooling, namely, in the preferred embodiment of the present invention, in addition to sense the heart rate of the user, the metal plates 72 on the second grip portions 44 each defines a temperature variable area 80 on the surface of the respective metal plate 72 for actively rise or reduce the temperature of the temperature variable area 80 (It is not influenced by the surrounding temperature to rise or reduce the temperature passively). When the user chooses to grip the second grip portion 44, the palms of two hands could touch the metal plates 72 so that the hands of the user could feel the temperature of the temperature variable area 80. Besides, the temperature difference between the temperature of the hands and the temperature variable area 80 will generate heat conduction.

The control unit 60 is electrically connected to the temperature changing device 82. The control unit 60 is able to control the temperature changing device 82 to rise or reduce the temperature of the temperature variable area 80. Further, the control unit 60 could control the temperature of the temperature variable area 80 to rise to a warm temperature range, and could also control the temperature of the temperature variable area 80 to reduce to a cool temperature range. Specifically, the warm temperature range is higher than 38 degrees Celsius, such as a suitable temperature from 38 to 50 degrees Celsius for allowing the user to feel the temperature of the hands higher than the body temperature. In contrast, the cool temperature range is lower than 36 degrees Celsius, such as a suitable temperature range from 20 to 36 degrees Celsius for allowing the user to feel the temperature of the hands lower than the body temperature. In order to accurately control the actual temperature of the temperature variable area 80, the metal plates 72 have at least one temperature sensor 84 at an inner side for detecting the temperature of the respective metal plate 72. In the preferred embodiment, a temperature sensor 84 is disposed in between the two parallel metal plates 72 at the respective side. The control unit 60 is electrically connected to the temperature sensor 84. The control unit 60 is able to receive temperature values detected from the temperature sensor 84 as a feedback for controlling the temperature changing device 82. Basically, the control unit 60 will control the temperature of all temperature variable areas to be consistent.

The control unit 60 is able to control the display unit 54 to display the current temperature information of the temperature variable area 80 such as the specific temperature value. Besides, the handle assembly 40 may have at least one light indicating device (not shown) at a suitable position of the handle assembly 40, for example, next to the temperature variable area 80. The control unit 60 is able to control the light indicating device to make the light indicating device show a light signal in accord with the temperature of the temperature variable area 80. For example, when the temperature of the temperature variable area 80 corresponds to the warm temperature range, the light indicating device shows a warm signal, such as red light; when the temperature of the temperature variable area 80 corresponds to the cool temperature range, the light indicating device shows a cool signal, such as blue light for allowing the user to identify quickly. Such light indicating device may be disposed on the console 50 as a part of the display unit 54.

The input unit 52 is provided for the user to input a command about temperature requirements such as requirement for temperature rising, requirement for temperature reducing, requirement for a specific temperature. The control unit 52 controls the temperature changing device 82 according to the command about the temperature requirement so as to make the temperature of the temperature variable area 80 correspond to the temperature requirement. For example, the input unit 52 may be provided with a "warm feeling button", a "cool feeling button", a "temperature rising button", a "temperature reducing button", or the like. The user could press the warm feeling button to make the temperature of the temperature variable area 80 become a specific temperature within the warm temperature range, such as 44 degrees Celsius or other preset values; press the cool feeling button to make the temperature of the temperature variable area 80 become a specific temperature within the cool temperature range, such as 26 degrees Celsius or other preset values; press the temperature rising button to make the temperature of the temperature variable area 80 rise 0.5 or 1 degree Celsius per time until an upper temperature limit; press the temperature reducing button to make the temperature of the temperature variable area 80 reduce 0.5 or 1 degree Celsius per time unit a lower temperature limit. Such buttons may be disposed on a suitable position of the handle assembly 40, for example, a suitable position corresponding to the thumb on the respective second grip portion 44.

Under this arrangement, the user could direct or adjust the temperature of the temperature variable area 80 and grip the second grip portions 44 with two hands or one hand, and thereby the user could touch the temperature variable area 80 with hands to obtain a warm feeling or cool feeling so as to adjust the body temperature suitably or at least make the body comfortable, such that the user could perform and complete workout in a preferred condition. For example, when the temperature is high, the indoor environment is muddy, the body keeps heating without well heat radiating, or any other reasons for obtaining cool feeling, the user could adjust the temperature of the temperature variable area 80 to a suitable temperature within the cool temperature range to make the hands which grip the second grip portions 44 feel cool so as to cool down the body temperature suitably (or stop continue to rise), and therefore to avoid or ease heat discomfort during exercise and prevent any heat injury. In contrast, when the temperature is cool, cold hands/feet, or any other reasons for obtaining warm feeling, the user could adjust the temperature of the temperature variable area 80 to a suitable temperature within the warm temperature range to make the hands which grip the second grip portions 44 feel warm so as to warm up the body temperature suitably, and therefore to warm the body to do exercise.

In the preferred embodiment of the present invention, the exercise apparatus 10 further comprises an atmospheric temperature sensor 90 for detecting the surrounding temperature of the exercise apparatus 10. The control unit 60 is electrically connected to the atmospheric temperature sensor 90. The control unit 60 is able to receive temperature atmospheric values detected from the atmospheric temperature sensor 90 and control the display unit 54 to display the atmospheric temperature information. In one control mode, the control unit 60 will be controlled to reduce the temperature of the temperature variable area 80 (usually reduce to the cool temperature range) as the atmospheric temperature is higher than a preset high temperature value. In contrast, the control unit 60 will be controlled to rise the temperature of the temperature variable area 80 (usually rise to the warm temperature range) as the atmospheric temperature is lower than a preset low temperature value. Furthermore, the temperature of the temperature variable area 80 may be varied with the atmospheric temperature, namely, the higher atmospheric temperature, the lower temperature of the temperature variable area; the lower atmospheric temperature, the higher temperature of the temperature variable area. Therefore, the exercise apparatus 10 is able to automatically adjust the temperature of the temperature variable area 80 of the respective second grip portion 44 to a comfortable temperature according to the surrounding temperature where the exercise apparatus 10 placed.

Furthermore, the control unit 60 is able to control the temperature changing device according to the exercise status of the user to automatically rise or reduce the temperature of the temperature variable area 80 during exercise. The following examples illustrate several possible control modes and their purpose and efficiency.

In one control mode, the control unit 60 is controlled to rise the temperature of the temperature variable area 80 during a warm-up stage of the exercise, and/or to reduce the temperature of the temperature variable area 80 during a cool-down stage of the exercise. For example, the control unit 60 could control the difficulty changing device 32 sequentially according to an exercise program which includes a time setting item and a difficulty setting item for allowing the user to perform the exercise according to the time setting item and the difficulty setting item. The exercise program defines an overall exercise time. The anterior predetermined period of the overall exercise time is defined as a warm-up period, and the exercise difficulty in the warm-up period is relatively low or gradually increased. The last predetermined period of the overall exercise time defined as a cool-down period, and the exercise difficulty in the warm-up period is relatively low or gradually increased. The control unit 60 is controlled to rise the temperature of the temperature variable area 80 in at least part of time during the warm-up period (generally, the temperature is risen from the original temperature to the warm temperature range), and controlled to reduce the temperature of the temperature variable area 80 in at least part of time during the cool-down period (but the temperature is not exactly reduced from the original temperature to the cool temperature range). Therefore, according to the user's personal situation, the user could choose to grip the second grip portions 44 during the warm-up stage of the exercise, since the temperature of the temperature variable area 80 is risen, the body temperature of the user is increased following the temperature of the hands easily so as to help to achieve warm-up effect. Besides, the user could also choose to grip the second grip portions 44 during the cool-down stage of the exercise, since the temperature of the temperature variable area 80 is reduced, the body temperature of the user is decreased following the temperature of the hands easily so as to help to achieve cool-down effect.

In another control mode, in at least part of time during exercise (e.g. the formal exercise stage after warm-up stage and before cool-down stage), if the user grips the second grip portions 44 and his heart rate is detected by the heart rate sensor 70, the control unit 60 is controlled to rise the temperature of the temperature variable area 80 when the heart rate value is below a predetermined range (e.g. such heart rate range is determined by user's age or determined by the user's physical condition or the exercise target) and the temperature of the temperature variable area 80 has not reached an upper temperature limit. In contrast, the control unit 60 is controlled to reduce the temperature of the temperature variable area 80 when the heart rate value is above the predetermined range and the temperature of the temperature variable area 80 has not reached a lower temperature limit. Thus, since the heart rate generally reflects exercise intensity at the time during exercise, namely, in this control mode, the control unit 60 determines whether the exercise intensity is too low/high to control the temperature of the temperature variable area 80 being suitably risen/reduced for increasing/decreasing the body temperature of the user who grips the second grip portions 44 so as to induce the user to increase/decrease the exercise intensity for guiding the user to do exercise with suitable exercise intensity so as to help the user to achieve good movement effect and avoid over training.

With respect to the aforementioned control modes, generally, the exercise apparatus 10 comprises at least one physiology sensing device (such as heart rate sensor 70), and the physiology sensing device is able to detect at least one physiology parameter of the user (such as heart rate). The control unit 60 is controlled to rise or reduce the temperature of the temperature variable area 80 according to the physiology parameter. Basically, when the exercise intensity of the user is determined too low based on the aforementioned physiology parameter, it is controlled to rise the temperature of the temperature variable area 80. In contrast, when the exercise intensity of the user is determined too high based on the physiology parameter, it is controlled to reduce the temperature of the temperature variable area 80. The physiology parameter for reflecting the body intensity or assisting to determine exercise intensity comprises: heart rate, respiratory rate, blood pressure, oxygen saturation, body temperature, electrocardiograph signals, or electromyogram signals. Specifically, the physiology sensing device for detecting the user's physiology parameter (including heart rate sensor) does not necessarily contact with the user via the surface of the handle assembly. For example, in the conventional technology, various sensing apparatuses may be worn on the user's chest, wrist or ears, then transmit correlated signals to the control unit via wireless transmission technology. Such sensing apparatuses worn on the user's body may regard as one part of the exercise apparatus of the present invention.

In another control mode, in at least part of time during exercise, the control unit 60 is able to calculate exercise intensity during the exercise according to the difficulty level determined by the difficulty changing device 32 (as the resistance of pedal mechanism in the present embodiment) and the movement speed value of the motion mechanism 30 detected by the speed sensor 34 (as the rotational speed of the pedal mechanism in the present embodiment). For example, it could adopt the method for measuring the metabolic equivalent (MET) of the user for conventional indoor bikes, then obtaining the metabolic equivalent value as an index corresponding to the exercise intensity. The control unit 60 is controlled to rise the temperature of the temperature variable area 80 when the exercise intensity or the metabolic equivalent is below a predetermined range and the temperature of the temperature variable area 80 is below an upper temperature limit. In contrast, the control unit 60 is controlled to reduce the temperature of the temperature variable area 80 when the exercise intensity or the metabolic equivalent is above the predetermined range and the temperature of the temperature variable area 80 is above a lower temperature limit. Specifically, for example, when the pedal resistance is moderate but the pedal rotational speed is slow/fast, or the pedal rotational speed is moderate but the pedal resistance is weak/strong so that the metabolic equivalent is too low/high, the temperature variable area is controlled to rise/reduce temperature. Such control mode could guide the user to do exercise with suitable exercise intensity as well.

Compared to above control modes, there is another simple control mode. In at least part of time during exercise, the control unit 60 is controlled to rise the temperature of the temperature variable area 80 when the movement speed value is below a predetermined range (means the exercise intensity too low) and the temperature of the temperature variable area 80 is below an upper temperature limit. In contrast, the control unit 60 is controlled to reduce the temperature of the temperature variable area 80 when the movement speed value is above the predetermined range (means the exercise intensity too high) and the temperature of the temperature variable area 80 is above a lower temperature limit. Relative to the application of indoor bikes, such control mode is preferred to be applied to treadmills and stair exerciser apparatuses. For treadmills and stair exerciser apparatuses, the movement speed of the motion mechanism (namely the belt mechanism or the stair mechanism) directly reflects the exercise difficulty of the motion mechanism and the exercise intensity of the user.

Referring back to FIG. 2, in the preferred embodiment of the present invention, which uses the metal plates 72 of the heart rate sensor 70 as the temperature variable area 80, such that the handle assembly 40 has simple appearance and high practicability. For example, the handle assembly 40 could provide warm/cool feeling for hands while detecting the heart rate. However, the exercise apparatus of the present invention is not limited to the grip portions of the handle assembly having the function for heart rate detecting. Even without the heart rate sensor, the exercise apparatus of the present invention could also dispose similar metal plates on the grip portion of the handle assembly as the temperature variable area. Even the exercise apparatus has the heart rate sensor; it does not necessarily use its metal plates as the temperature variable area. In other words, the temperature variable area may be located out of the metal plate used for detecting the heart rate. As the handle assembly 40 shown in FIG. 2, the metal plates for detecting the heart rate are disposed on the top of the second grip portions 44, and the temperature variable area could arranged on the bottom of the second grip portion or the first grip portions 42.

In the preferred embodiment of the present invention, the temperature variable area is not limited to the surface of the metal plates. For example, in another embodiment (not shown), there is a metal tube inside the grip portion, and the outer periphery of the metal tube is coated with a plastic layer. The user directly contacts the plastic layer as griping the grip portion. The metal tube is heated or cooled by the temperature changing device directly, and its temperature will be transmitted to the plastic layer. In this case, the surface of the plastic layer becomes the temperature variable area. Furthermore, in another embodiment (not shown), the grip portion has a plurality of apertures, and the inside air warmed or cooled by the temperature changing device could blow through the grip portion via the apertures to make the user's hands feel warm or cool. In this case, the region with the apertures becomes the temperature variable area.

According to types of exercise apparatuses, the exercise apparatuses suitable for the present invention may have one, two or more handle assembly. Each handle assembly may be fixed or movable. Each handle assembly has at least one grip portion which may be provided for allowing specific or any hand to grip, or it may be provided for the user to grip with two hands. Every grip portion may have one, two or more temperature variable area, or may have no temperature variable area. Each temperature variable area may occupy a small portion, a large portion or whole surface of the grip portion. However, the handle assembly of the exercise apparatus of the present invention must provide the user with at least one grip way for allowing the user to touch the temperature variable area with two hands so as to obtain a warm feeling or cool feeling simultaneously.

In the present invention, maybe single temperature changing device is able to make the temperature of the temperature variable area rise to the warm temperature range and make the temperature of the temperature variable area reduce to the cool temperature range. For example, the temperature changing device includes at least one thermoelectric material or semiconductor element with thermoelectric material (commonly known as thermoelectric chips) for functions of heating and cooling based on the thermoelectric effect so as to rise the temperature of the temperature variable area to a range from 38 to 50 degrees Celsius, or to reduce the temperature of the temperature variable area to a range from 20 to 36 degrees Celsius. Besides, heat pump also has functions of heating and cooling. The application of thermoelectric materials or heat pump as cooler or heater is conventional technique, and the correlated principle is not mentioned herein.

Additionally, the present invention may have a first temperature changing device to rise the temperature of the temperature variable area to the warm temperature range, and a second temperature changing device to reduce the temperature of the temperature variable area to the cool temperature range.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a motion mechanism for a user to perform an exercise;

a handle assembly having at least one grip portion for being held by the user during exercising, the at least one grip portion having at least one temperature variable area thereon;

at least one temperature changing device configured to control temperature of the temperature variable area;

a control unit configured to control the temperature changing device to raise or reduce the temperature of the temperature variable area; and at least one temperature sensor coupled with the temperature variable area and the control unit so that the control unit is capable of receiving temperature value detected from the temperature variable area as a feedback for controlling the temperature changing device.

2. The exercise apparatus as claimed in claim 1, wherein the control unit controls the temperature changing device according to exercise status of the user to automatically raise or reduce the temperature of the temperature variable area during the exercise.

3. The exercise apparatus as claimed in claim 2, wherein the control unit is controlled to raise the temperature of the temperature variable area during a warm-up stage of the exercise.

4. The exercise apparatus as claimed in claim 3, wherein the exercise apparatus further comprises a difficulty changing device configured to change difficulty level of the motion mechanism for the user to perform the exercise; the control unit controls the difficulty changing device sequentially according to an exercise program which includes a time setting item and a difficulty setting item for allowing the user to perform the exercise according to the time setting item and the difficulty setting item; the exercise program defines an overall exercise time, and an anterior predetermined period of the overall exercise time is defined as a warm-up period; and the control unit is controlled to raise the temperature of the temperature variable area in at least part of the time during the warm-up period.

5. The exercise apparatus as claimed in claim 4, wherein the overall exercise time has a last predetermined period defined as a cool-down period, and the control unit is controlled to reduce the temperature of the temperature variable area in at least part of the time during the cool-down period.

6. The exercise apparatus as claimed in claim 2, wherein the control unit is controlled to reduce the temperature of the temperature variable area during a cool-down stage of the exercise.

7. The exercise apparatus as claimed in claim 2, wherein the exercise apparatus further comprises at least one physiology sensing device for detecting at least one physiology parameter of the user, and the control unit is controlled to raise or reduce the temperature of the temperature variable area according to the physiology parameter in at least part of the time during the exercise.

8. The exercise apparatus as claimed in claim 7, wherein the at least one physiology sensing device comprises a heart rate sensor for detecting a heart rate of the user; the control unit is able to receive values of the heart rate; in at least part of the time during the exercise, the control unit is controlled to raise the temperature of the temperature variable area when the heart rate value is below a predetermined range and the temperature of the temperature variable area is below an upper temperature limit, and the control unit is controlled to reduce the temperature of the temperature variable area when the heart rate value is above the predetermined range and the temperature of the temperature variable area is above a lower temperature limit.

9. The exercise apparatus as claimed in claim 2, wherein the exercise apparatus further comprises a difficulty changing device and a speed sensor, the difficulty changing device configured to change difficulty level of the motion mechanism for the user to perform the exercise, the speed sensor configured to detect movement speed of the motion mechanism for the user to perform the exercise; the control unit is able to control the difficulty changing device to change difficulty level of the exercise and receive movement speed values detected from the speed sensor, and the control unit is able to calculate exercise intensity during the exercise according to the difficulty level and the movement speed value; in at least part of the time during the exercise, the control unit is controlled to raise the temperature of the temperature variable area when the exercise intensity is below a predetermined range and the temperature of the temperature variable area is below an upper temperature limit, and the control unit is controlled to reduce the temperature of the temperature variable area when the exercise intensity is above the predetermined range and the temperature of the temperature variable area is above a lower temperature limit.

10. The exercise apparatus as claimed in claim 2, wherein the exercise apparatus further comprises a speed sensor for detecting movement speed of the motion mechanism for the user to perform the exercise; the control .unit is able to receive movement speed Values detected from the speed sensor; in at least part of time during the exercise, the control unit is controlled to raise the temperature of the temperature variable area when the movement speed value is below a predetermined range and the temperature of the temperature variable area is below an upper temperature limit, and the control unit is controlled to reduce the temperature of the temperature variable area when the movement speed value is above the predetermined range and the temperature of the temperature variable area is above a lower temperature limit.

11. The exercise apparatus as claimed in claim 1, wherein the exercise apparatus further comprises a heart rate sensor for detecting a heart rate of the user, the heart rate sensor comprising at least one metal plate mounted on the grip portion, the metal plate having a surface defined as the temperature variable area.

12. The exercise apparatus as claimed in claim 1, wherein the temperature changing device is configured to raise the temperature of the temperature variable area to the a warm temperature range above body temperature of the user and to reduce the temperature of the temperature variable area to a cool temperature range below body temperature of the user.

13. The exercise apparatus as claimed in claim 12, wherein the temperature changing device comprises a thermoelectric material.

14. The exercise apparatus as claimed in claim 1, wherein the handle assembly further comprises at least one light indicating device, and the control unit is able to control the light indicating device to make the light indicating device show a light signal in accord with the temperature of the temperature variable area.

15. The exercise apparatus as claimed in claim 1, wherein the exercise apparatus further comprises an input unit allowing the user to input a command about a temperature requirement, and the control unit controls the temperature changing device according to the command about the temperature requirement so as to make the temperature of the temperature variable area correspond to the temperature requirement.

16. The exercise apparatus as claimed in claim 1, wherein the exercise apparatus further comprises an atmospheric temperature sensor for detecting a surrounding temperature where the exercise apparatus placed; the control unit is able to receive temperature atmospheric values detected from the atmospheric temperature sensor and control the temperature of the temperature variable area reducing to a cool temperature range above body temperature of the user, and the control unit controls the temperature of the temperature variable area raising to a warm temperature range below body temperature of the user.

17. The exercise apparatus as claimed in claim 12, wherein the warm temperature range is defined from 38 to 50 degrees Celsius.

18. The exercise apparatus as claimed in claim 12, wherein the cool temperature range is defined from 20 to 36 degrees Celsius.

19. An exercise apparatus, comprising:

a motion mechanism for a user to perform an exercise;

a handle assembly having at least one grip portion for being held by the user during exercising, the at least one grip portion having at least one temperature variable area thereon;

at least one temperature changing device configured to control temperature of the temperature variable area;

an input unit for the user to input a command;

a display unit for displaying information to the user;

a control unit configured to receive and process the command from the input unit, controlling the display unit to show the information, and controlling the temperature changing device according to exercise status of the user to raise or reduce the temperature of the temperature variable area during the exercise; and at least one metal plate mounted on the grip portion, the metal plate having a surface defined as the temperature variable area; and a temperature sensor coupled with the temperature variable area and the control unit;

wherein the control unit is configured to raise the temperature of the temperature variable area above body temperature of the user detected from the temperature variable area, and to reduce the temperature of the temperature variable area below body temperature of the user detected from the temperature variable area.

* * * * *